US007188454B2

(12) United States Patent
Mowery et al.

(10) Patent No.: US 7,188,454 B2
(45) Date of Patent: Mar. 13, 2007

(54) SIDING PANEL WITH INSULATED BACKING PANEL

(75) Inventors: Jack T. Mowery, Medina, OH (US); James Zechinati, Granger, IN (US); Benjamin L. McGarry, Cape Coral, FL (US)

(73) Assignee: Associated Materials, Inc., Akron, OH (US)

( * ) Notice: Subject to any disclaimer, the term of this patent is extended or adjusted under 35 U.S.C. 154(b) by 0 days.

(21) Appl. No.: 11/181,167

(22) Filed: Jul. 14, 2005

(65) Prior Publication Data

US 2006/0053716 A1 Mar. 16, 2006

Related U.S. Application Data

(63) Continuation of application No. 10/917,973, filed on Aug. 13, 2004, now Pat. No. 7,040,067.

(51) Int. Cl.
*E04D 1/00* (2006.01)

(52) U.S. Cl. ..... 52/539; 52/521; 52/558

(58) Field of Classification Search ..... 52/519, 52/520, 521, 536, 538, 539, 545, 558, 309.8
See application file for complete search history.

(56) References Cited

U.S. PATENT DOCUMENTS 2,961,804 A * 11/1960 Beckman ..... 52/539
3,248,835 A * 5/1966 Westlind ..... 52/404.4
3,703,795 A * 11/1972 Mattes ..... 52/521
4,788,808 A * 12/1988 Slocum ..... 52/521
4,969,302 A * 11/1990 Coggan et al. ..... 52/309.8
5,090,174 A * 2/1992 Fragale ..... 52/309.9
5,425,210 A * 6/1995 Zafir ..... 52/404.4
5,636,489 A * 6/1997 Leverrier et al. ..... 52/540
5,878,543 A * 3/1999 Mowery ..... 52/519
6,298,626 B2 * 10/2001 Rudden ..... 52/520
6,321,500 B1 * 11/2001 Manning et al. ..... 52/555
6,341,463 B1 * 1/2002 Dickey et al. ..... 52/521

* cited by examiner

*Primary Examiner*—Naoko Slack
(74) *Attorney, Agent, or Firm*—Banner & Witcoff, Ltd.

(57) ABSTRACT

A siding panel of a siding assembly has a nailing hem and a first upwardly opening channel connected to the nailing hem. A downwardly opening channel is connected to the first channel. An upper portion of an upper course forms a portion of the downwardly opening channel. An upper shoulder extends inwardly and upwardly from the upper course to an upper edge of a lower course. A lower shoulder extends inwardly and upwardly from a lower edge of the lower course. A planar member extending upwardly from the lower shoulder, the lower shoulder and a portion of the lower course form a second upwardly opening channel. A rib of an insulating panel is received in the first downwardly opening channel. A projection is received by the second upwardly opening channel. A shoulder abuts the upper shoulder of the siding panel.

17 Claims, 2 Drawing Sheets

SIDING PANEL WITH INSULATED BACKING PANEL

This application is a continuation of prior application Ser. No. 10/917,973, filed on Aug. 13, 2004 now U.S. Pat. No. 7,040,067, which is incorporated herein by reference in its entirety.

FIELD OF THE INVENTION

This invention relates generally to siding, and, in particular, to siding having an insulated backing panel.

BACKGROUND OF THE INVENTION

Siding, or wall siding, is commonly used to cover the exterior surfaces, e.g. walls, of structures. Such siding is often formed of metal, such as aluminum, or thermoplastic materials, such as polyvinyl chloride (PVC). Siding installed on vertical surfaces may be formed with one or more sections or courses. The courses are often combined with horizontal shoulders to form a siding profile. The courses may be declinations, that is, downwardly extending flat portions, which combine with the horizontal shoulders to form a clapboard profile. The courses may have a dutch lap construction, which includes an upper portion that angles downwardly and outwardly to an upper edge of a downwardly extending lower portion.

Such siding is typically installed in multiple rows of panels, with each row overlapping the panels to which it is adjacent. Adjoining panels are overlapped in this manner to provide protection for the structure from the elements. Insulated panels may be positioned behind the siding in order to increase the insulative properties of the siding. The insulating panels, typically formed of foam, may be secured with an adhesive to the rear surface of the siding.

It is an object of the present invention to provide a siding panel with an insulated backing panel that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a siding panel with an insulated backing panel. In accordance with a first preferred embodiment, a siding panel assembly includes a siding panel comprising a nailing hem folded outwardly and back upon itself forming a lateral edge of the siding panel. A first upwardly opening channel is connected to the nailing hem. A first downwardly opening channel is connected to the first upwardly opening channel. An upper course has an upper edge and a lower edge, with an upper portion of the upper course forming a portion of the first downwardly opening channel. A lower course has an upper edge and a lower edge. An upper shoulder extends inwardly and upwardly from the lower edge of the upper course to the upper edge of the lower course. A lower shoulder extends inwardly and upwardly from the lower edge of the lower course. A planar member extends upwardly from a rear edge of the lower shoulder, with the planar member, lower shoulder and a portion of the lower course forming a second upwardly opening channel. A second downwardly opening channel is connected to the second upwardly opening channel. An insulating panel has a rib extending along an upper edge thereof, with the rib being received in the first downwardly opening channel. A projection extends along a lower edge of the insulating panel, with the projection being received by the second upwardly opening channel. A shoulder is positioned above and abuts the upper shoulder of the siding panel.

In accordance with another preferred embodiment, a siding panel assembly includes a siding panel having a nailing hem folded outwardly and back upon itself to form a lateral edge of the siding panel and having a plurality of slots formed therein. A first arcuate member is connected at a first end thereof to the nailing hem and forms a first upwardly opening channel. A second arcuate member is connected at a first end thereof to a second end of the first arcuate member and at a second end thereof to an upper edge of an upper course. The first arcuate member, the second arcuate member and an upper portion of the upper course form a first downwardly opening channel. A lower course has an upper edge and a lower edge. An upper shoulder extends inwardly and upwardly from a lower edge of the upper course to the upper edge of the lower course. A lower shoulder extends inwardly and upwardly from the lower edge of the lower course. A planar member extends upwardly from a rear edge of the lower shoulder, with the planar member, lower shoulder and a portion of the lower course forming a second upwardly opening channel. A third arcuate member is connected at a first end thereof to an upper edge of the planar member and forms a second downwardly opening channel. The third arcuate member terminates in a downwardly and rearwardly extending lip. An insulating panel includes a rib extending along an upper edge thereof, with the rib being received in the first downwardly opening channel. A projection extends along a lower edge thereof, with the projection being received by the second upwardly opening channel. A shoulder extends inwardly and upwardly, with the shoulder being positioned above and abutting the upper shoulder. A recess is formed along a lower rear edge of the insulating panel.

In accordance with yet a further embodiment, a siding panel assembly includes a siding panel having a nailing hem folded outwardly and back upon itself, forming a lateral edge of the siding panel. A first upwardly opening channel is connected to the nailing hem. A a first downwardly opening channel is connected to the first upwardly opening channel. A course has an upper edge and a lower edge, with an upper portion of the course forming a portion of the first downwardly opening channel. A shoulder extends inwardly and upwardly from the lower edge of the course. A planar member extends upwardly from a rear edge of the shoulder, with the planar member, shoulder and a portion of the course forming a second upwardly opening channel. A second downwardly opening channel is connected to the second upwardly opening channel. An insulating panel has a rib extending along an upper edge thereof, with the rib being received in the first downwardly opening channel. A projection extends along a lower edge of the insulating panel, with the projection being received in the second upwardly opening channel. A shoulder extends inwardly and upwardly from a front edge of the projection.

Substantial advantage is achieved by providing a siding panel with an insulated backing panel. In particular, certain preferred embodiments of the present invention provide an integrated assembly that is easy to handle and install, provides superior insulative properties, is resistant to wind forces, and allows expansion of the siding panel and insulated backing panel independently of one another. These and additional features and advantages of the invention disclosed here will be further understood from the following detailed disclosure of certain preferred embodiments.

Figure 1:
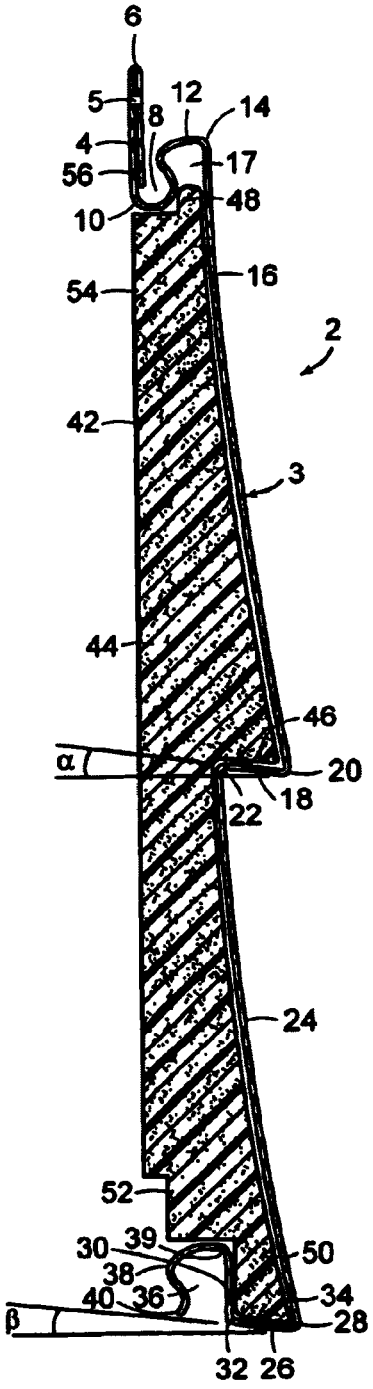
FIG. 1 is a section view of a preferred embodiment of a siding panel having an insulated backing panel in accordance with the present invention.

The figures referred to above are not drawn necessarily to scale and should be understood to provide a representation of the invention, illustrative of the principles involved. Some features of the siding panel having an insulated backing panel depicted in the drawings have been enlarged or distorted relative to others to facilitate explanation and understanding. The same reference numbers are used in the drawings for similar or identical components and features shown in various alternative embodiments. Siding panels having an insulated backing panel as disclosed herein would have configurations and components determined, in part, by the intended application and environment in which they are used.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume wall siding attached to the walls of a structure such as a house. These directional references are given in reference to the surface or plane, such as the ground, upon with the structure sits, and the plane of the wall of the structure itself. Horizontal, therefore, refers to a direction which is substantially parallel to the surface plane and substantially perpendicular to the wall of the structure. Vertical refers to a direction which is substantially parallel to the wall of the structure and substantially perpendicular to the surface. Outwardly refers to a direction moving substantially horizontally away from the structure upon which the siding is attached, while inwardly refers to a direction moving substantially horizontally toward the structure. Downwardly refers to a direction moving substantially vertically toward the surface and upwardly refers to a direction moving substantially vertically away from the surface. Lower and upper refer to vertical directions with lower being closer to the surface than upper. Left and right are in reference to directions given when one is looking at the structure.

A first preferred embodiment of an insulated siding panel assembly 2 is shown in FIG. 1. As described in greater detail below, this embodiment of an insulated siding panel assembly 2 has a clapboard profile. Insulated siding panel assembly 2 comprises a siding panel 3 having a nailing hem 4, which is folded outwardly and back upon itself to form a lateral edge 6 at an upper edge of siding panel 3. Folding nailing hem 4 in such a manner increases its strength and resistance to being separated from the wall of the structure to which it is secured and, therefore, provides very high wind tolerances for such siding.

Siding panel 3 is typically installed in a vertical fashion on a substantially vertical surface, and nailing hem 4 extends along an upper edge of the panel. Nailing hem 4 includes a plurality of slots 5 along its length, which receive nails for securing siding panel 4 to a structure as described in greater detail below.

A first upwardly opening channel 8 is formed along panel 3, with a portion of nailing hem 4 forming a rear wall of channel 8. An upwardly curving arcuate member 10 is connected to a lower edge of nailing hem 4 and has an upper portion that is positioned in front of and curves rearwardly toward nailing hem 4. Arcuate member 10 forms the bottom and front wall of channel 8 such that channel 8 is substantially U-shaped. A downwardly curving arcuate member 12 joins an upper edge of arcuate member 10 to an upper edge 14 of a first or upper course 16. In this embodiment, each course is formed of a declination, which, when used here, refers to a substantially planar portion of siding panel 3 that slopes downwardly and slightly outwardly from an upper edge thereof. Course 16 is preferably flat in order to closely approximate the appearance of wood siding. In certain embodiments, course 16 may be slightly concave. Arcuate member 12 and an upper portion of upper course 16 define a first downwardly opening channel 17.

A first or upper shoulder 18 extends inwardly and slightly upwardly at an angle $\alpha$ from a lower edge 20 of upper course 16 to an upper edge 22 of a second or lower course 24. In a preferred embodiment, angle $\alpha$ is between approximately 5° and 10°, and more preferably approximately 7°. A second or lower shoulder 26 extends inwardly and slightly upwardly at an angle $\beta$ from a lower edge 28 of lower course 24. In a preferred embodiment, angle $\beta$ is between approximately 5° and 10°, and more preferably approximately 7°.

It can be seen that in the illustrated embodiment the combination of the declinations and shoulders provide the appearance of clapboards when siding panels 3 are installed on a structure.

A planar member 30 extends upwardly from a rear edge 32 of lower shoulder 26. Planar member 30, lower shoulder 26 and a lower portion of lower course 24 cooperate to define a second upwardly opening channel 34.

A second downwardly opening substantially U-shaped channel 36 is positioned rearwardly of upwardly opening channel 34 and is defined by planar member 30 and a downwardly curving arcuate member 38. Arcuate member 38 extends from an upper edge 39 of planar member 30 and terminates in a lip 40 that extends downwardly and rearwardly away from arcuate member 38.

An insulating panel 42 is positioned behind and adjacent siding panel 3. Panel 42 includes a body portion 44. A shoulder 46 is formed on a front surface of a central portion of panel 42. Shoulder 46 is configured to abut and mate with an upper surface of upper shoulder 18 of panel 3 and, therefore, also angles slightly upwardly and rearwardly at angle $\alpha$. A rib 48 is formed along an upper front edge of panel 3. An extension 50 is formed along a lower front edge of panel 3. A recess 52 is formed along a lower rear edge of panel 3. In certain preferred embodiments, when insulating panel 42 is assembled with siding panel 3, a rear surface 54 of panel 3 is substantially flush with a rear surface 56 of nailing hem 4.

Insulating panel 42 may be formed, for example, of an expandable polystyrene (EPS) foam, or polyurethane. Other suitable materials for insulating panel 42 will become readily apparent to those skilled in the art, given the benefit of this disclosure.

To assemble insulated siding panel assembly 2, a user inserts extension 50 of an insulating panel 42 into upwardly opening channel 34 of a siding panel 3. The upper portion of siding panel 3 is then engaged with insulating panel 42 such that upper shoulder 18 of siding panel 3 passes over shoulder 46 of insulating panel 42 and a lower surface of channel 8 passes over rib 48 until rib 48 is located within downwardly opening channel 17. Thus, insulating panel 42 is captured by siding panel at its upper end, where rib 48 is captured within downwardly opening channel 17, and at its lower end, where projection 50 is captured within channel 34 in a friction fit manner. Additionally, upper shoulder 18 captures shoulder 46 of insulating panel 42, since they are both inclined upwardly and rearwardly at angle $\alpha$.

Figure 2:
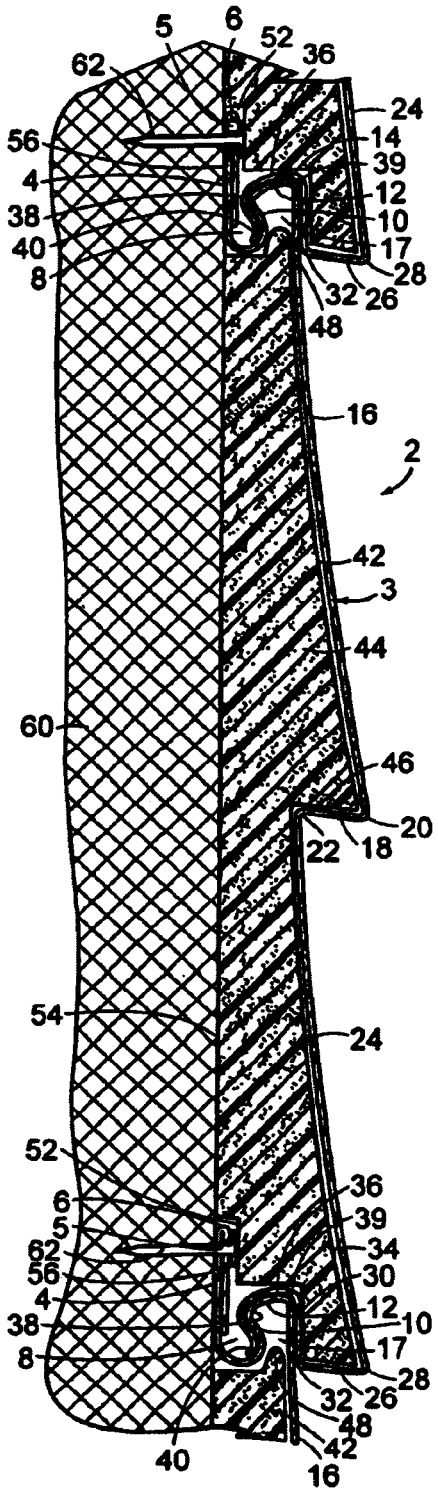
FIG. 2 is a section view of the siding panel of FIG. 1, shown installed on a wall of a structure with two vertically adjacent siding panels, each of which is shown partially broken away.

As seen in FIG. 2, siding panel 3 mates in interlocking fashion with vertically adjacent siding panels 3. Siding panels 3 are preferably installed from the bottom up on a wall 60 of a structure. Three interlocking siding panels 3 are depicted here, with the lowermost siding panel 3 (shown here partially broken away) being installed first by way of nails 62 extending through slots 5 in nailing hem 4. As those skilled in the art can appreciate, nails 62 are driven into wall 60 only to the extent that they capture nailing hem 4 while allowing siding panel 3 to float, or move, longitudinally along wall 60, thereby accommodating thermal expansion and contraction of siding panel 3.

The next vertically adjacent siding panel 3 (seen here in its entirely as the middle of the three panels) is installed by holding an upper portion of it outwardly away from wall 60 and inserting lip 40 in upwardly opening recess 8 of the lowermost siding panel 3 in a "stack-on" manner. In this manner, arcuate member 38 and lip 40 of the middle siding panel 3 interlock with and engage arcuate member 12 of the lowermost siding panel 3 such that the middle siding panel 3 is positively engaged with the lowermost siding panel 3. This mating engagement ensures that vertically adjacent and overlapping panels are secured to one another in a positive manner. Such positive interlocking substantially prevents the separation of adjacent installed panels and, therefore, increases the wind tolerances for such siding.

Siding panel 3 is then tilted inwardly to wall 60 and nails 62 are driven in to wall 60 through slots 5 of nailing hem 4 of the middle siding panel 3. When installed, nailing hem 4 of the lowermost siding panel 3 is received by recess 52 of the middle insulating panel 42 such that rear surface 54 of insulating panel 42 behind the middle siding panel 3 is substantially flush with rear surface 56 of nailing hem 4 of the lowermost siding panel 3. The construction of siding panel 3 and insulating panel 42 provides a substantially constant thickness of insulation along siding panel assembly 2, enhancing the insulative value, or R factor, of insulated siding panel assembly 2.

Once the middle siding panel 3 has been installed, the next vertically adjacent siding panel (seen here as the topmost siding panel and shown broken away with only its lowermost edge visible) is installed in a similar stack-on manner. Subsequent siding panels are also installed in similar fashion. When installed, the multiple siding panels 3 overlie or overlap one another such that they give a clapboard siding effect to the multiple panels installed on a structure.

Siding panels 3 may be formed of, for example, rigid polyvinyl chloride (PVC) or other suitable materials that will become readily apparent to those skilled in the art, given the benefit of this disclosure. In a preferred embodiment, siding panels 3 are formed of a sheet of PVC having a thickness of about 0.03 to about 0.06 inches, and more preferably about 0.050 inches.

In certain preferred embodiments, upper course 16 and lower course 24 are each approximately 6 inches high. This provides a siding panel 3 approximately 12 inches in height, which can easily be handled by an installer, and is a convenient size for many applications. It is to be appreciated, however, that the height of siding panel 3 is not to be limited to approximately 12 inches, and may in fact be larger or smaller than 12 inches. Suitable sizes for siding panel 3 will become readily apparent to those skilled in the art, given the benefit of this disclosure.

Figure 3:
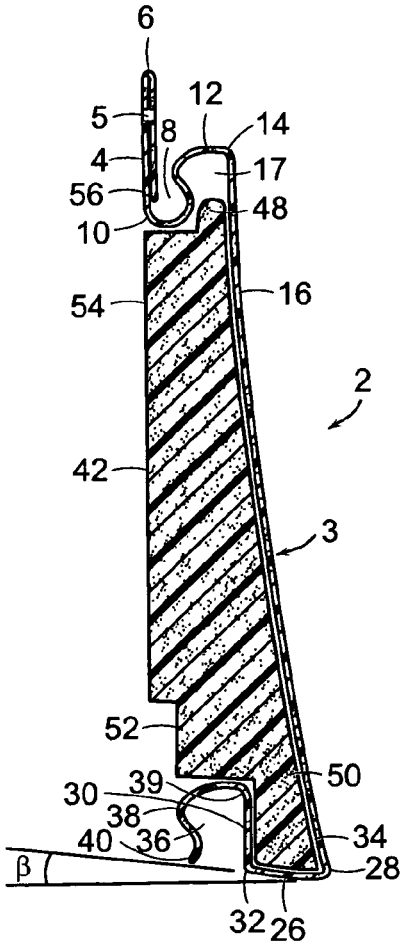
FIG. 3 is a section view of an alternative embodiment of a siding panel having a single course and an insulated backing panel in accordance with the present invention.

It is also to be appreciated that siding panel 3 may include a single course, as illustrated in FIG. 3, in which first course 16 extends from upper edge 14 downwardly and outwardly to lower edge 28.

In other preferred embodiments, siding panel 3 may have more than two courses. Such a siding panel would naturally have an additional shoulder for each additional course.

Figure 4:
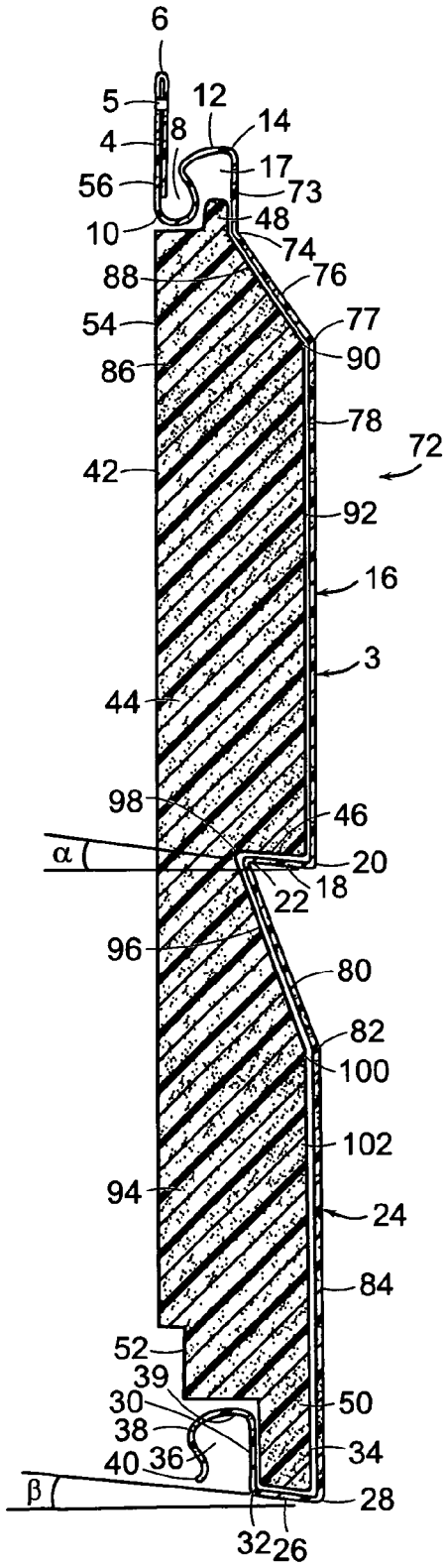
FIG. 4 is a section view of an alternative embodiment of a siding panel having a dutch lap profile and a mating insulated backing panel in accordance with the present invention.

As noted above, the courses of siding panel 3 may have shapes other than declinations that form a clapboard profile. Another example is illustrated in FIG. 4, in which an insulated siding panel assembly 72 has a dutch lap profile. Upper course 16 has a first portion 73 that extends vertically downward from upper edge 14 to an upper edge 74 of a second portion 76 that angles outwardly and downwardly form upper edge 74 to an upper edge 77 of a third portion 78 that extends downwardly and substantially vertically from upper edge 76 to lower edge 20 of upper course 16.

Lower course 24 has a first portion 80 that angles outwardly and downwardly from upper edge 22 to an upper edge 82 of a second portion 84 of lower course 24 that extends downwardly and substantially vertically from upper edge 82 to lower edge 28 of lower course 16. Insulating panel 42 naturally has a shape that conforms with the dutch lap profile, with an upper portion 86 of body portion 44 including an upper front face 88 angling downwardly and outwardly from rib 48 to an upper edge 90 of a substantially vertical front face 92 of upper portion 86. A lower portion 94 of body portion 44 includes an upper front face 96 angling downwardly and outwardly from an inner edge 98 of shoulder 46 to an upper edge 100 of a substantially vertical front face 102 of lower portion 94.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A siding panel assembly comprising, in combination:

a siding panel comprising a nailing hem folded outwardly and downwardly, forming a lateral edge of the siding panel;

a first upwardly opening channel connected to the nailing hem;

a first downwardly opening channel connected to the first upwardly opening channel;

an upper course having an upper edge and a lower edge, an upper portion of the upper course forming a portion of the first downwardly opening channel;

a lower course having an upper edge and a lower edge;

an upper shoulder extending inwardly and upwardly from the lower edge of the upper course to the upper edge of the lower course;

a lower shoulder extending inwardly and upwardly from the lower edge of the lower course;

a second upwardly opening channel connected to the lower edge of the lower course, the lower shoulder forming a portion of the second upwardly opening channel; and a second downwardly opening channel connected to the second upwardly opening channel; and an insulating panel having a projection extending along a front lower edge thereof, the projection being received in the second upwardly opening channel, and a shoulder positioned above the upper shoulder of the siding panel.

2. The siding panel assembly of claim 1, wherein each of the upper shoulder, the lower shoulder, the shoulder of the insulating panel, and a lower surface of the projection is angled upwardly and inwardly at an angle of between approximately 5° and approximately 10°.

3. The siding panel assembly of claim 1, wherein the upper shoulder, the lower shoulder, the shoulder of the insulating panel, and a lower surface of the projection each are angled upwardly and inwardly at approximately the same angle.

4. The siding panel assembly of claim 1, wherein a rear surface of the insulating panel is substantially flush with a rear surface of the nailing hem.

5. The siding panel assembly of claim 1, wherein the insulating panel includes a recess along a lower rear edge thereof.

6. The siding panel assembly of claim 1, wherein each upper course and lower course is substantially flat.

7. The siding panel assembly of claim 1, wherein each upper course and lower course is slightly concave.

8. The siding panel assembly of claim 1, wherein the second downwardly opening channel is configured to receive the first downwardly opening channel of an adjacent like siding panel.

9. The siding panel assembly of claim 1, wherein the siding panel is formed substantially of PVC.

10. The siding panel assembly of claim 1, wherein the insulating panel is formed of foam.

11. The siding panel assembly of claim 1, wherein the insulating panel is formed of EPS.

12. The siding panel assembly of claim 1, wherein the nailing hem has a plurality of slots formed therein.

13. A siding panel assembly comprising, in combination:

a siding panel comprising a nailing hem;

a first upwardly opening channel connected to the nailing hem;

a first downwardly opening channel connected to the first upwardly opening channel;

an upper course having an upper edge and a lower edge, an upper portion of the upper course forming a portion of the first downwardly opening channel;

a lower course having an upper edge and a lower edge;

an upper shoulder extending inwardly from the lower edge of the upper course to the upper edge of the lower course;

a lower shoulder extending inwardly from the lower edge of the lower course;

a second upwardly opening channel connected to the lower edge of the lower course, the lower shoulder forming a portion of the second upwardly opening channel; and a second downwardly opening channel connected to the second upwardly opening channel; and an insulating panel having a projection extending along a front lower edge thereof, the projection being received in the second upwardly opening channel, and a shoulder positioned above the upper shoulder of the siding panel.

14. The siding panel assembly of claim 13, wherein a rear surface of the insulating panel is substantially flush with a rear surface of the nailing hem.

15. The siding panel assembly of claim 13, wherein the insulating panel includes a recess along a lower rear edge thereof.

16. The siding panel assembly of claim 13, wherein the nailing hem has a plurality of slots formed therein.

17. The siding panel assembly of claim 13, in which a surface of the insulating panel substantially conforms to a contour of the courses and shoulders of the siding panel.

* * * * *